US006326865B1

(12) United States Patent
Kundu et al.

(10) Patent No.: US 6,326,865 B1
(45) Date of Patent: Dec. 4, 2001

(54) DUAL-MODE FILTER AND DESIGN METHOD THEREFOR

(75) Inventors: Arun Chandra Kundu, Tokyo; Ikuo Awai, Ube, both of (JP)

(73) Assignees: TDK Corporation, Tokyo; IKUO Awai, Yamaguchi-ken, both of (JP)

( * ) Notice: Subject to any disclaimer, the term of this patent is extended or adjusted under 35 U.S.C. 154(b) by 0 days.

(21) Appl. No.: 09/532,258

(22) Filed: Mar. 22, 2000

(30) Foreign Application Priority Data

Sep. 30, 1999 (JP) ..... 11-278009

(51) Int. Cl.[7] ..... H01P 1/20; H01P 5/12
(52) U.S. Cl. ..... 333/202; 333/204; 333/134
(58) Field of Search ..... 333/202, 204, 333/205, 219, 134

(56) References Cited

U.S. PATENT DOCUMENTS 5,172,084 * 12/1992 Fiedziuszko et al. ..... 333/204
5,804,534 * 9/1998 Zaki ..... 333/202
6,157,274 * 12/2000 Tada et al. ..... 333/204

OTHER PUBLICATIONS

"A Joint Field/Circuit Design Model of Microstrip Ring Dual–Mode Filter:Theory and Experiments", Zhu et al., 1997 Asia Pacific Microwave Conf., pp. 865–868, 1997.
"Explanation and Control of Attenuation Poles in a Microstrip Circular Disk Resonator BPF", Kundu et al., Technical Report of IEICE. MW 98–16 (1998–05), pp. 25–32.
"Theory on Rotated Excitation of a Circular Dual–Mode Resonator and Filter", Awai et al., 1997 IEEE MTT–S Digest, pp. 781–784.
"Microstrip Bandpass Filter Using Degenerate Modes of a Microstrip Ring Resonator", Electronic Letters, vol. 8, No. 12, Jun. 1972, pp. 302–303.
"Two–Stage Bandpass Filters Based on Rotated Excitation of Circular Dual–Mode Resonators", Awai et al., IEEE Microwave and Guided Wave Letters, vol. 7, No. 8, Aug. 1977, pp. 212–213.
"General Theory of a Circular Dual–Mode Resonator and Filter", I. Awai, IEICE Trans. Electron., vol. E81–C, No. 11, Nov. 1998, pp. 1757–1763.
"Stripline Dual–Mode Ring Resonators and Their Application to Microwave Devices", Yabuki et al., IEEE Trans. on Microwave Theory and Techniques, vol. 44, No. 5, May 1996, pp. 723–728.
"Miniature Dual Mode Microstrip Filters", Curtis et al., 1991 IEEE MTT–S Digest, pp. 443–446.
Geometrical Structures and Fundamental Characteristics of Microwave Stepped–Impedance Resonators, Sagawa et al., IEEE Trans. on Microwave Theory and Tech., vol. 45, No. 7, Jul. 1997, pp. 1078–1085.

* cited by examiner

*Primary Examiner*—Robert Pascal
*Assistant Examiner*—Patricia T. Nguyen
(74) *Attorney, Agent, or Firm*—Frishauf, Holtz, Goodman, Langer & Chick, P.C.

(57) ABSTRACT

In a dual-mode filter, this invention is capable of optionally setting an attenuation pole frequency with maintaining a passbandwidth of the filter by selecting a combination of an angle between input/output ports and a size of a stub perturbation. The dual-mode filter includes a circular resonator formed on a dielectric substrate, a pair of input/output ports connected to the circular resonator through a capacitance formed on the substrate at a symmetrical position with respect to a symmetry plane passing through a center of the circular shape of the circular resonator, and stub poles are formed on the substrate radially extending along the symmetry plane from opposite positions of the circular resonator in the diametrical direction with each other. The pair of input/output ports are formed with defining an angle different from a right angle therebetween. When the angle between the pair of input/output ports is smaller or greater than 90°, an attenuation pole frequency can optionally be set by this angle and the size of the stub perturbation.

9 Claims, 10 Drawing Sheets

FIG. 3

$$y_1 = \frac{jb_p + j2\tan\beta(l-x)}{2 - b_p\tan\beta(l-x)} \quad (1)$$

$$y_2 = jb_e + \frac{jb_p + j2\tan\beta x}{2 - b_p\tan\beta x} \quad (2)$$

$y_1, y_2$ ··· input admittance at the reference plane $b_p$ ··· normalized perturbation susceptance $b_e$ ··· normalized external circuit susceptance $\beta_o$ ··· propagation constant without perturbation $\beta$ ··· propagation constant with perturbation $l = \pi a$ ··· half of the average perimeter of ring resonator $B_c = \omega_o C_e$ $\omega_o$ ··· angular resonant frequency without perturbation $$b_e = \frac{2\pi f C_e G}{[G^2 + (2\pi f)^2 C_e^2] y_a} \quad (3)$$

$$b_p = \frac{y_b}{y_a}\tan\beta_o d$$

$y_a$ ··· characteristic admittance of the ring resonator $y_b$ ··· characteristic admittance of the perturbation stub

FIG. 4

$$\Delta\beta_e^2[A(2lx-l^2)\tan\beta_o x\sec^2\beta_o x-B(l-x)^2\tan^2\beta_o x\sec^2\beta_o x+B(xl-x^2)\sec^4\beta_o x-Bx^2\tan^2\beta_o x\sec^2\beta_o x]+\Delta\beta_e[Al\sec^2\beta_o x+B(l-2x)\tan\beta_o x\sec^2\beta_o x]+C-B\tan^2\beta_o x=0 \quad (4)$$

where $A=-b_p^2-2b_pb_e+4$, $B=-4b_p+b_p^2b_e$, $C=4(b_p+b_e)$ $$-\Delta\beta_{od}^2(2lx-l^2)\cot\beta_o x\,\mathrm{cosec}^2\beta_o x+\Delta\beta_{od}l\,\mathrm{cosec}^2\beta_o x+b_e=0 \quad (5)$$

$\Delta\beta_e$ ··· change of propagation constant in even mode $\Delta\beta_{od}$ ··· change of propagation constant in odd mode $$k=\frac{2\,|\,\Delta\omega_e-\Delta\omega_{od}\,|}{2\omega_o+\Delta\omega_e+\Delta\omega_{od}}=\frac{2\,|\,\Delta\beta_e-\Delta\beta_{od}\,|}{2\beta_o+\Delta\beta_e+\Delta\beta_{od}} \quad (6)$$

(f=2.08GHz,$y_a$=0.028336 S)

$Q_e$:External Quality Factor

DUAL-MODE FILTER AND DESIGN METHOD THEREFOR

TECHNICAL FIELD

This invention generally relates to a dual-mode band-pass filter comprising a circular resonator having a circular periphery and a pair of input/output ports.

BACKGROUND OF THE INVENTION

Such a dual-mode filter typically includes a circular resonator, such as a ring resonator, having a circular periphery, which is formed on a substrate made of a dielectric material, and a pair of input/output ports connected to the circular resonator through a capacitance for external circuit coupling, which is formed on the substrate at a symmetrical position with respect to a symmetry plane passing through the center of the circular shape of the circular resonator. Perturbation stubs are formed on the substrate to extend radially along the symmetry plane of the circular resonator at the diametrically opposite sides of the circular resonator. The pair of input/output ports is disposed outwardly in diametral direction with respect to the circular resonator in a manner to define a right angle therebetween.

In the paper of Lei Zhu, et al, "A Joint Field/Circuit Design Model of Microstrip Ring Dual-Mode Filter: Theory and Experiments", 1997 Asia Pacific Microwave Conference, pp. 865–868, several forms of such type of dual-mode filters are described.

As typically shown in FIG. 2 of the aforementioned paper, in the conventionally proposed dual-mode filters, the length of the stub pole should be changed in order to optionally determine an attenuation pole frequency of the filter. However, when the length of the perturbation stub was changed, there causes a problem that a coupling condition of the filter would be swerved from a critical coupling condition so that a passbandwidth of the filter would be simultaneously changed. Thus, in such conventional dual-mode filters, it has been highly difficult to optionally set an attenuation pole frequency with maintaining a constant passbandwidth of the filter.

SUMMARY OF THE INVENTION

It is an object of the present invention to provide a structure of a dual-mode filter and a design method therefor, which is capable of optionally setting an attenuation pole frequency with maintaining a constant passbandwidth of the filter.

Another object of the present invention is to provide a duplexer which has a new configuration comprising two dual-mode filters formed on a single dielectric substrate and a design method therefor.

A dual-mode filter of the present invention includes a circular resonator, such as a ring resonator, a circular disc resonator and the like, having a circular periphery, which is formed on a dielectric substrate, and a pair of input/output ports connected with the circular resonator through a capacitance for external circuit coupling, which is formed on the substrate at a symmetrical position with respect to a symmetry plane passing through a center of the circular shape of the circular resonator, stub perturbations are being formed on the substrate radially extending along the symmetry plane of the circular resonator from opposite positions of the circular pole in the diametrical direction with each other, wherein the pair of input/output ports are formed with defining an angle different from a right angle therebetween.

According to the findings of the inventors of the present invention, when an angle between the pair of input/output ports is different from a right angle, an attenuation pole frequency causing a minimum pass value of the filter can be controlled by a combinations of input/output angle and the size of the stub perturbation. More specifically, when the angle between the pair of input/output ports is at a right angle, the I/O port has no contribution on mutual coupling between the dual-modes as well as in the change of the attenuation pole frequency wherein energy transmission of the filters shows a minimum value. In contrast, when the angle between the pair of input/output ports takes a value different from a right angle it contributes in mutual coupling between dual-modes of the circular resonator as well as in positioning of the attenuation pole frequency. Hence we can fabricate a bandpass filter by having mutual coupling effect from the stub perturbations as well as input/output angle simultaneously, when I/O angle is different from right angle. But here the contribution of input/output angle and stub perturbations on the control of attenuation pole frequency does not cancel each other. As a result we can make various combinations of these two parameters to obtain a constant coupling for design of a constant bandwidth filter with controlled attenuation pole frequencies. A unique but complicating (second order) effect of external circuit susceptance is also included to characterize the coupling constant. With this principle, the attenuation pole frequency of the filter can be controlled over a wide range and a transmission characteristic of the filter can also diversely be changed.

Thus, in one aspect, the present invention provides a dual-mode filter including a dielectric substrate, a circular resonator having a circular periphery, which is formed on the dielectric substrate, a pair of input/output ports coupled to the circular resonator through a capacitance for external circuit coupling, which is formed on the substrate at a symmetrical position with respect to a symmetry plane passing through the center of the circular shape of the circular resonator, and stub perturbations are formed on the substrate to extend radially along the symmetry plane at the diametrically opposite sides of the circular resonator. One of the features of the present invention is that the pair of input/output ports is disposed to define an angle different from a right angle therebetween with maintaining a particular passbandwidth by the size of the stub perturbations.

In another aspect, the present invention provides a method of designing the aforementioned type of dual-mode filter. This method includes steps of: setting a particular passbandwidth of the filter, finding the aforementioned capacitance required for external circuit coupling, determining an angle between the pair of input/output ports a value different from a right angle, and figuring out a size of the stub perturbations for achieving the particular passbandwidth.

The present invention further provides a method for a dual-mode filter to control an attenuation pole frequency over a wide range, with maintaining a passbandwidth substantially constant. This method includes steps of: setting a particular passbandwidth of the filter, finding the capacitance for external coupling, determining a particular value of the attenuation pole frequency with which the pass value of the filter shows a minimum value, and then figuring out a combination of an angle different from a right angle between the pair of input/output ports and a size of the stub perturbations, required for achieving the particular value of the attenuation pole frequency with which the pass value of the filter shows a minimum value, with maintaining the aforementioned particular passbandwidth.

In yet another aspect, the present invention provides a duplexer in which two dual-mode filters are formed on a single substrate. This duplexer comprises a dielectric substrate; a first dual mode filter including a first circular resonator having a circular periphery, which is formed on the substrate, a pair of input/output ports coupled to the first circular resonator respectively through capacitances for external coupling, which are formed on the substrate at symmetrical positions with respect to a symmetry plane passing through the center of the circular shape of the first circular resonator, first stub perturbations for internal coupling, formed on the substrate radially extending along the symmetry plane from opposite positions of the first circular resonator in the diametral direction each other; and a second dual-mode filter including a second circular resonator having a circular periphery, which is formed on the substrate laterally alongside of the circular resonator, a pair of input/output ports coupled to the second circular resonator respectively through capacitances for external circuit coupling, which are formed on the substrate at symmetrical positions with respect to a symmetry plane passing through a center of the circular shape of the second circular resonator, and second stub perturbations for internal coupling, formed on the substrate radially extending along the symmetry plane from opposite positions of the second circular resonator in the diametrical direction with each other. This duplexer is characterized in that the angle between the pair of input/output ports of the first dual-mode filter and the angle between the pair of input/output ports of the second dual-mode filter are different of values each other, maintaining a particular passbandwidth by both sizes of the first stub perturbations and the second stub perturbations.

In still another aspect, the present invention provides a method for designing the aforementioned duplexer. This method includes steps of: setting a particular passbandwidth, and finding the capacitance required for external circuit coupling, with respect to the first and second dual-mode filter, respectively. This method further includes steps comprising; determining each particular value of a higher attenuation pole frequency of the first dual-mode filter and lower attenuation pole frequency of the second dual-mode filter, in the manner that the higher attenuation pole frequency with which a pass frequency of the first dual-mode filter shows a minimum value and the lower attenuation pole frequency with which a pass frequency of the second dial-mode filter shows a minimum value are gotten close but each performance curve with sharp skirt pass characteristic is never overlapped each other; and then figuring out a combination of an angle different from a right angle between the pair of input/output ports and a size of the stub perturbations, required for achieving the particular value of the attenuation pole frequency with sharp skirt characteristics, with maintaining the particular passbandwidth, with respect to the first and second dual-mode filter, respectively.

These and other aspect of the present invention are apparent in the following detailed description and claims, particularly when considered in conjunction with the accompanying drawings.

BRIEF DESCRIPTION OF THE DRAWINGS

FIG. 3 shows equations for calculating coupling coefficient.

FIG. 4 shows relational expressions gotten from the equations shown in FIG. 3.

DESCRIPTION OF THE PREFERRED EMBODIMENT

Figure 1:
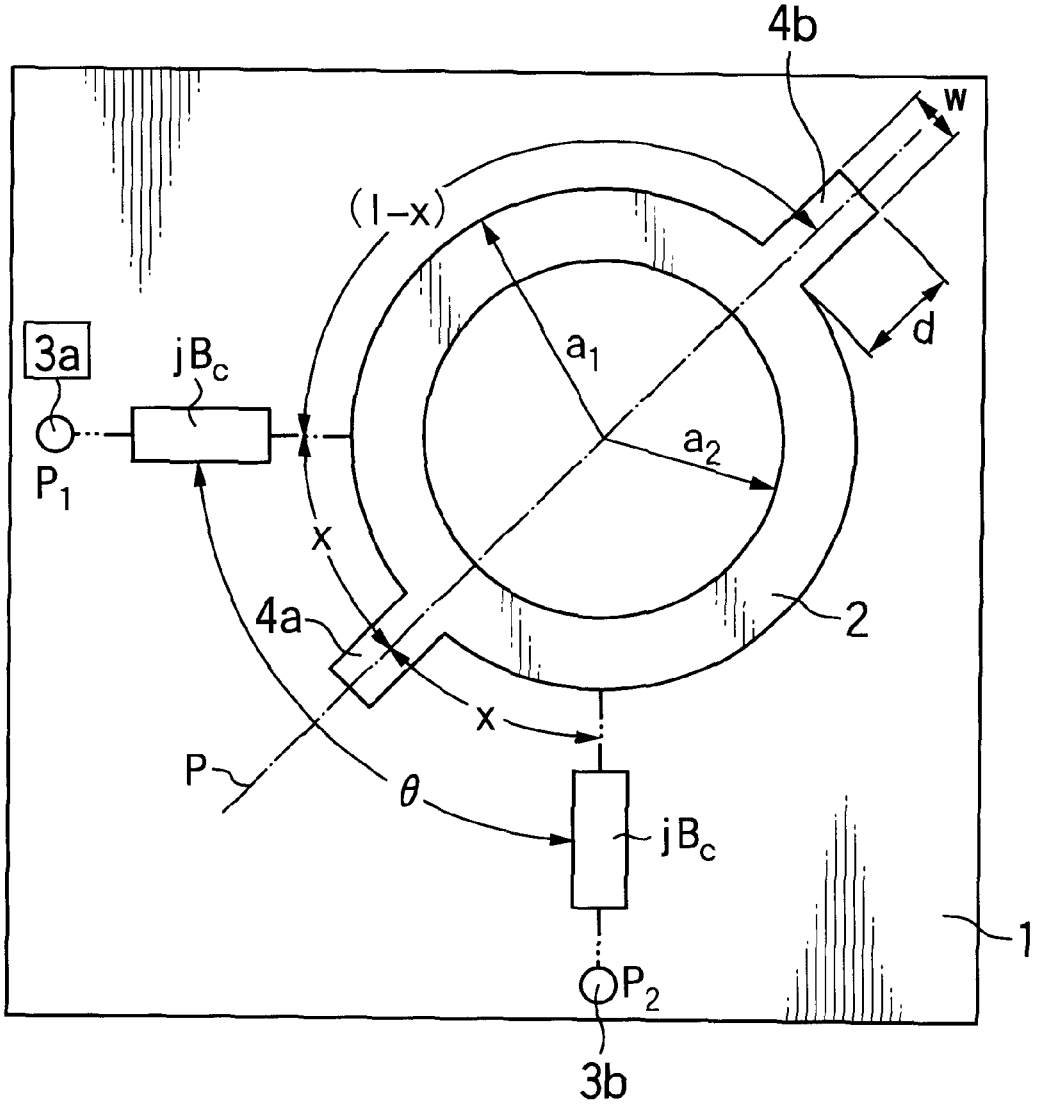
FIG. 1 is a plan view showing an example of a dual-mode band-pass filter according to the present invention.

Referring to the drawings, particular embodiments of the present invention are described as follows. In FIG. 1, which shows an example of a dual-mode band-pass filter implementing the present invention, this filter includes a rectangular substrate 1 made of dielectric material and a ground electrode (not shown) is formed on a back surface of the substrate 1. A ring resonator 2 having a circular periphery, which is formed on the substrate. This ring resonator 2 has external radius of $a_1$ internal radius of $a_2$ and averaged radius of a. A circular disc resonator may be used as a substitute of the ring resonator 2. As used in the following description, the term "circular resonator" refers to resonator including both a ring resonator and a circular disc resonator. Input/output ports 3*a* and 3*b* are disposed on the substrate 1 and are connected to the circular resonator 2 via chip capacitances for external circuit coupling, between the circular resonator 2 and the input/output ports 3*a* and 3*b*. In FIG. 1, susceptance be is shown as representation of a physical value including this capacitance and a resistance value of 50 ohm of the input/output ports. A symmetry plane P is defined on the circular resonator 2 to symmetrically position the input/output ports 3*a* and 3*b* each other.

As a feature of the present invention, an angle θ between the input/output ports 3*a* and 3*b* is selected from a value different from a right angle, for example a smaller angle than 90°, such as any angle in the range from 70° to 80°. However, the same result can be obtain even if the angle is larger than 90°. A pair of stub perturbations 4*a* and 4*b* for the resultant perturbation effect is formed on the substrate, extending outwardly in the diametral direction along the symmetry plane P from the outer edge of the circular resonator 2 each other. This stub perturbations 4*a* and 4*b* have width of w and length of d. When representing by a distance in circumferential direction along a circular arc of the averaged radius a of the circular pole 2, each distance from a longitudinal center line of one of the stub perturbation 4*a* to each of the input/output port 3*a* and 3*b* is represented by x, while each distance from a longitudinal center line of the other of the stub perturbations 4*b* to each of the input/output port 3*a* and 3*b* is represented by l−x, where $l=\pi a$.

Figure 2A:
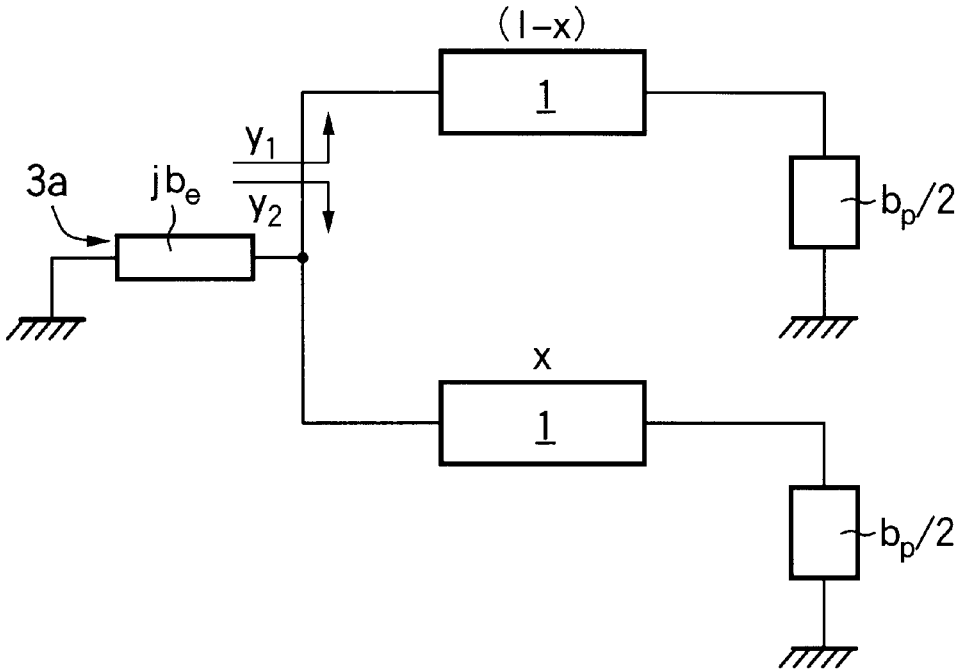
FIGS. 2*a* and 2*b* shows equivalent circuits of the filter shown in FIGS. 1, and 2(*a*) shows an equivalent circuit for even mode resonance and 2(*b*) shows an equivalent circuit for odd mode resonance.
Figure 2B:
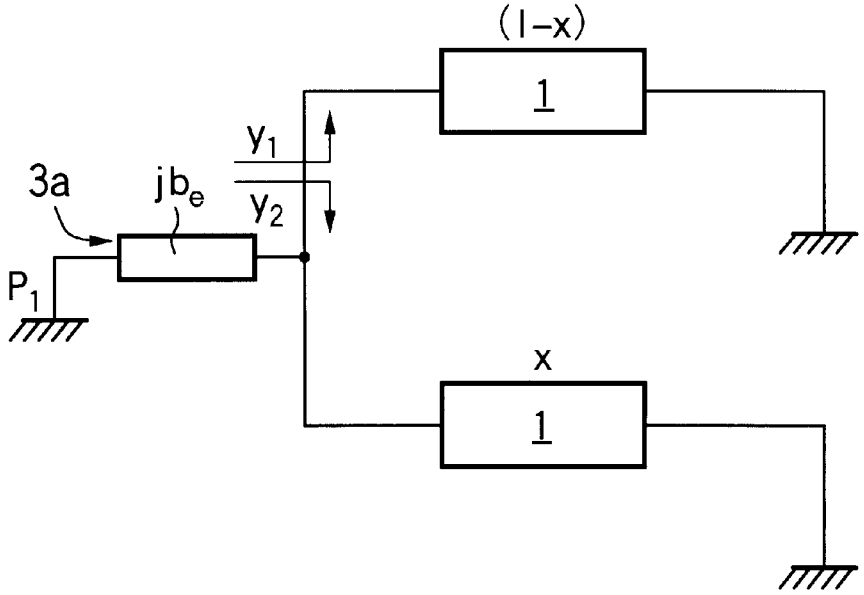

FIG. 2(*a*) shows an equivalent circuit for calculating resonant frequency in even mode resonance of the dual-mode filter shown in FIG. 1, wherein $b_p$ is normalized perturbation susceptance. Since the symmetry plane P acts as an open end in even mode resonance, an equivalent circuit of the filter can be expressed as shown in FIG. 2(*a*). In this case, input admittances $Y_1$ and $Y_2$ can be expressed by the formula (1) and (2) shown in FIG. 3, wherein normalized external circuit susceptance $b_e$ can be calculated using the formula (3) shown in FIG. 3.

At resonance condition, a condition expression of $y_1+y_2=0$ (zero) is fulfilled.

Let us suppose that $$\beta=\beta_0+\Delta\beta_e.$$

In other words, the resonance frequency is shifted a little from the original resonance condition due to the perturbations, where propagation constant β is used to represent the resonant frequency. The relation expressed by the formula (4) shown in FIG. 4 can be obtained by expanding the abovementioned condition expression $y_1+y_2=0$ in Taylor series and by neglecting the terms of higher order than $\Delta\beta^2$, with respect to even mode resonance. In odd mode resonance, an equivalent circuit of the filter can be expressed as shown in FIG. 2(*b*) because the symmetry plane P acts as short-circuit. The relation expressed by the formula (5) shown in FIG. 4 can be obtained by the same calculation procedure. Thus, coupling coefficient k can be calculated by using the formula (6) shown in FIG. 4.

Based on these conditions, a dual-mode band-pass filter is considered to design, which has resonance frequency of 2.08 GHz at no perturbation and bandwidth of 8.6% standardized by the center frequency. In this case, the coupling coefficient required is 0.061 and thus external coupling capacitance $C_e$ must be 1 pF to obtain this coupling coefficient. Hence, for the angle θ between input/output ports of 70° and 80° and additional 90° for comparative purpose, the relation between external circuit coupling capacitance $C_e$ and coupling coefficient is examined. The result is shown in FIG. 5.

Figure 5:
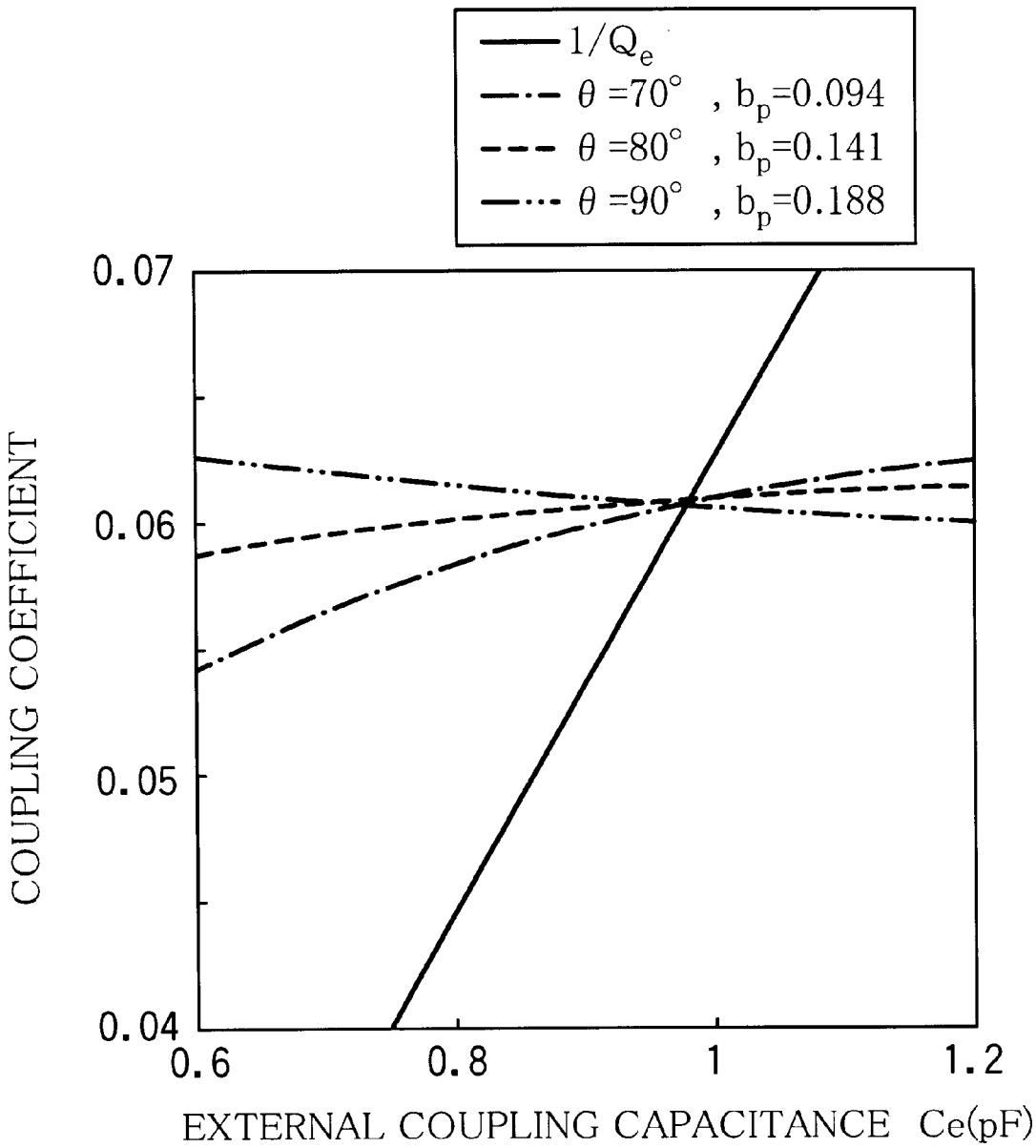
FIG. 5 is a diagram showing a relation between the capacitance for external circuit coupling and the coefficient of coupling, with respect to various angles between input/output ports.

FIG. 5 shows a data resulted from the selection of the stub perturbation susceptance by which coupling capacitance of 0.061 can be obtained when external circuit capacitance $C_e$ is 1 pF for each of the aforementioned set angles θ between the input/output ports 3*a* and 3*b*. It can be observed from FIG. 5 that when the input/output angle is decreasing the amount of stub susceptance required to produce the same amount of mutual coupling is decreasing i.e., the amount of mutual coupling contributed by input/output angle is increasing.

Figure 6:
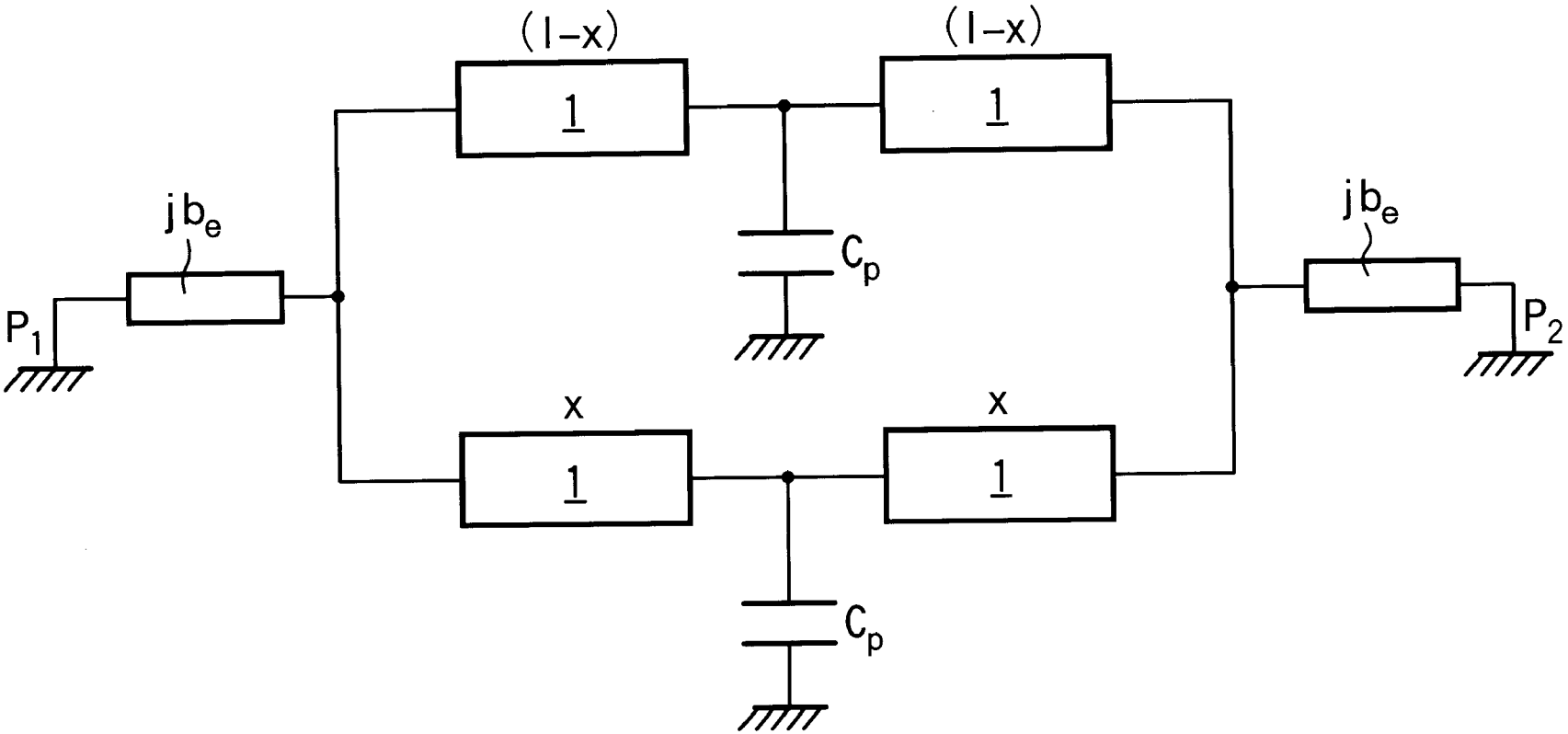
FIG. 6 shows an equivalent circuit of a band-pass filter.
Figure 7:
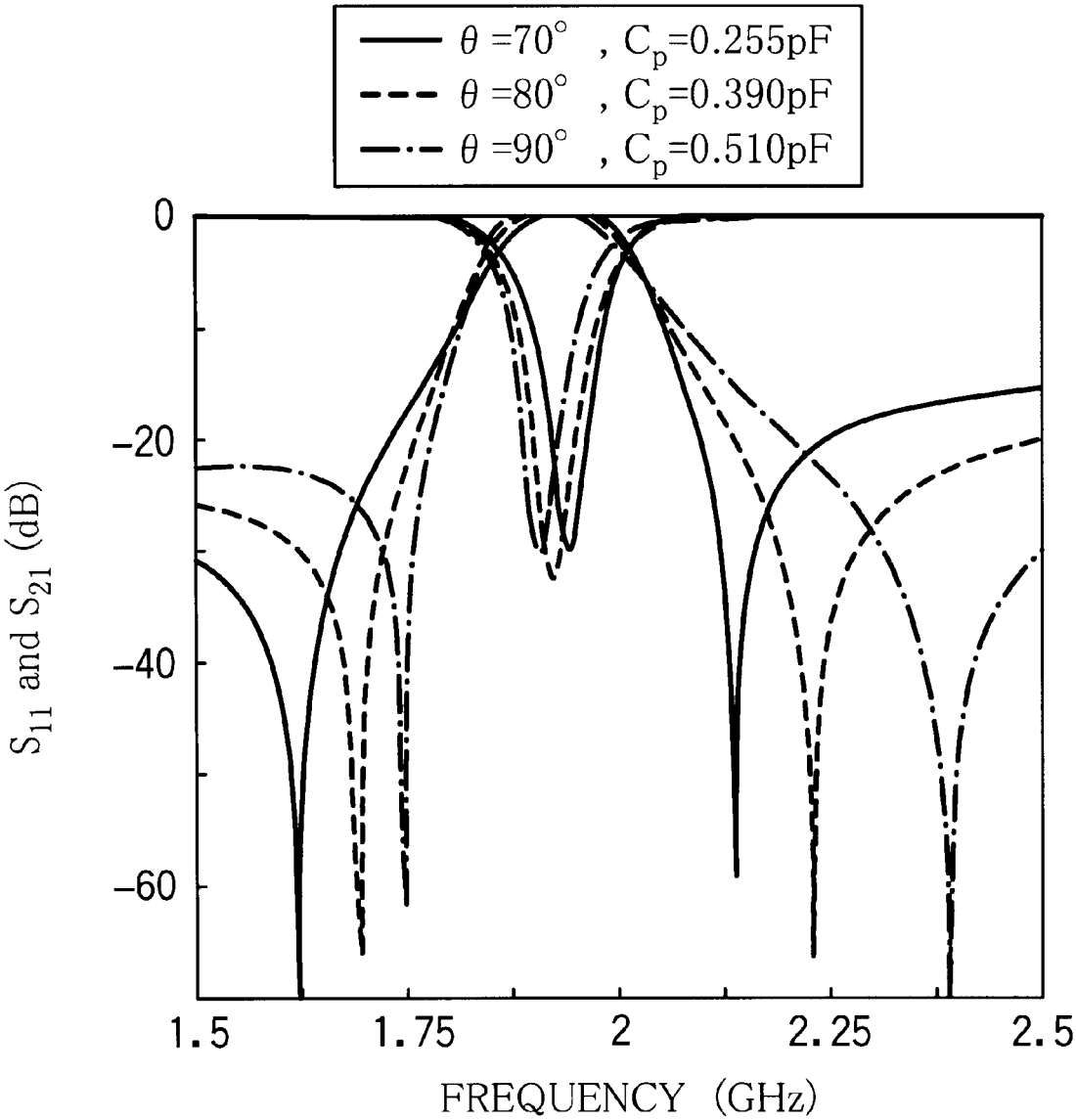
FIG. 7 is a diagram showing a result from figuring out transmission characteristics of a filter based on simulation computing.

FIG. 6 shows an equivalent circuit of the filter with setting the size of the stub perturbations 4*a* and 4*b* corresponding to the angle between the input/output ports and also considering the effect caused from these settings. An example is shown in FIG. 7, in which propagation characteristic of the filter is simulated by using this equivalent circuit. FIG. 7 shows a data in which the angle θ between input/output ports 3*a* and 3*b* is set at 70°, 80° and 90° and the size of the stub perturbations, i.e. capacitance offered by the stub perturbations 4*a* and 4*b* is then set to maintain the bandwidth substantially constant, as conditions. As is apparent from the result shown in FIG. 7, when the angle θ between input/output ports 3*a* and 3*b* is 70°, both lower and higher attenuation pole frequencies are sifted toward lower frequency side compared with those in the angle θ between input/output ports 3*a* and 3*b* of 80° and 90°. When the angle is 70°, the transmission characteristic of the filter shows relatively sharp skirt characteristics at higher frequency side of the passbandwidth. In contrast, when the angle θ is 90°, both lower and higher attenuation pole appear in higher frequency side compared with those in the angle θ of 80° and 70°. In this case, the transmission characteristic of the filter shows relatively sharp skirt characteristics at lower frequency side than the pass bandwidth. When the angle θ is 80°, in-between transmission characteristic to those in 70° and 90° is shown. The passbandwidth of the simulated BPFs remains constant for all the combinations of I/O angles mentioned above. The characteristic in larger angle θ than 90° can be figured out in the same way.

As is apparent from the previous description, under the condition that the pass bandwidth is maintained in constant, a frequency with which amount of attenuation of the filter is shown a minimum value can optionally be set by selecting the combination of an angle θ between the input/output ports 3*a* and 3*b*, and the size, i.e. capacitance, of the stub perturbations 4*a*, 4*b*. In FIG. 7, for each angle θ between input/output ports 3*a* and 3*b*, a little shift of the filter center frequency can be seen. This is caused from change of the size of the perturbation stub i.e., numerical value of the perturbation capacitance $C_p$, which governs susceptance $b_p$ are one of two parameters having effect to filter center frequency, whereto capacitance $C_e$, which is the other parameter, is set at the constant value of 1 pF.

Figure 8:
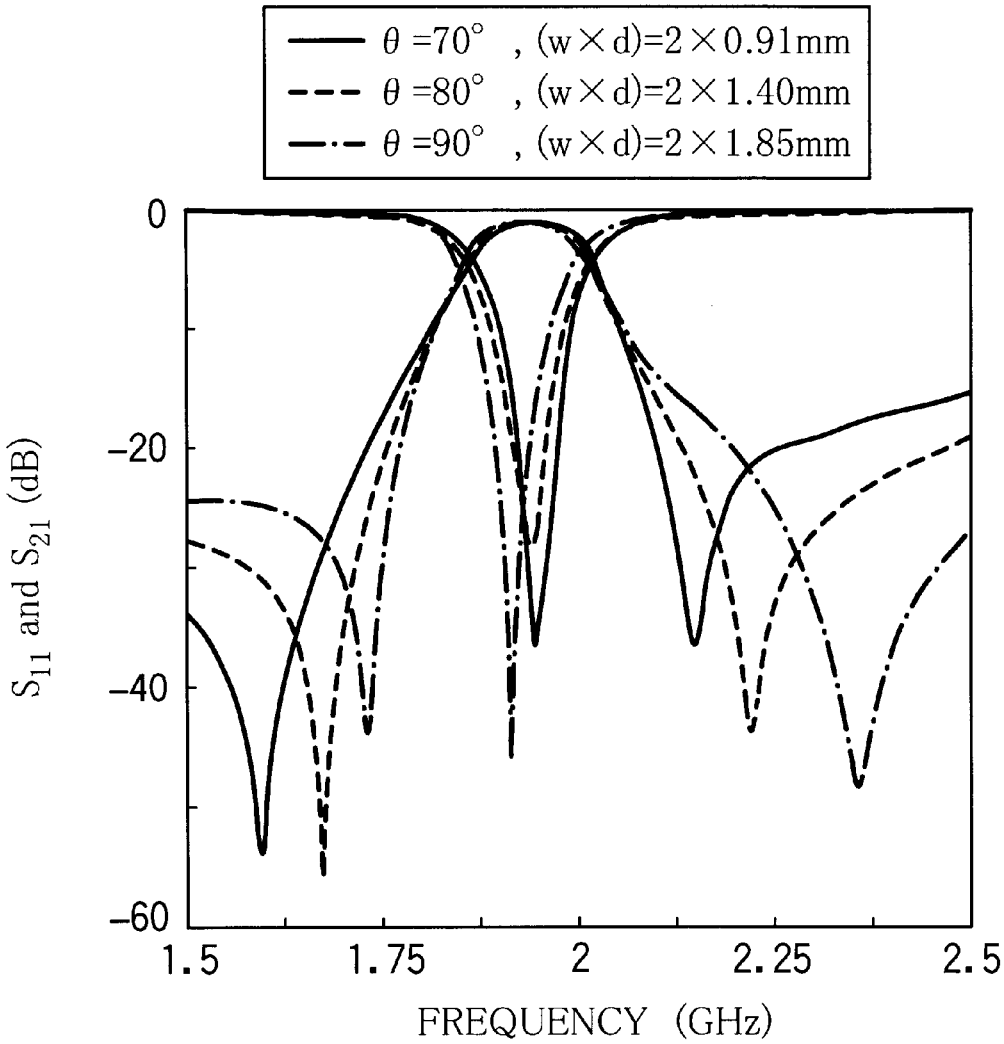
FIG. 8 is a diagram showing a result from measuring transmission characteristics in an actual model.

FIG. 8 shows a result measured in a filter model actually fabricated under the same conditions as those of filter used for the calculation in FIG. 7. Comparing FIG. 7 and FIG. 8, it can be seen that the actual result is highly corresponding to the calculated result. In addition, with FIG. 7 and FIG. 8, a frequency with which attenuation is shown can optionally be set, with maintaining the passbandwidth constant, by setting the angle between the input/output ports 3*a* and 3*b* in a value different from a right angle, and also selecting the combination of the size, i.e. capacitance, of the stub perturbations and the angle θ between the input/output ports 3*a* and 3*b*. In the actual measurement, the decibel attenuation value of the attenuation pole shows smaller value than the calculated value in FIG. 7. This is caused from taking no consideration to a loss in the calculation model in FIG. 7.

Figure 9:
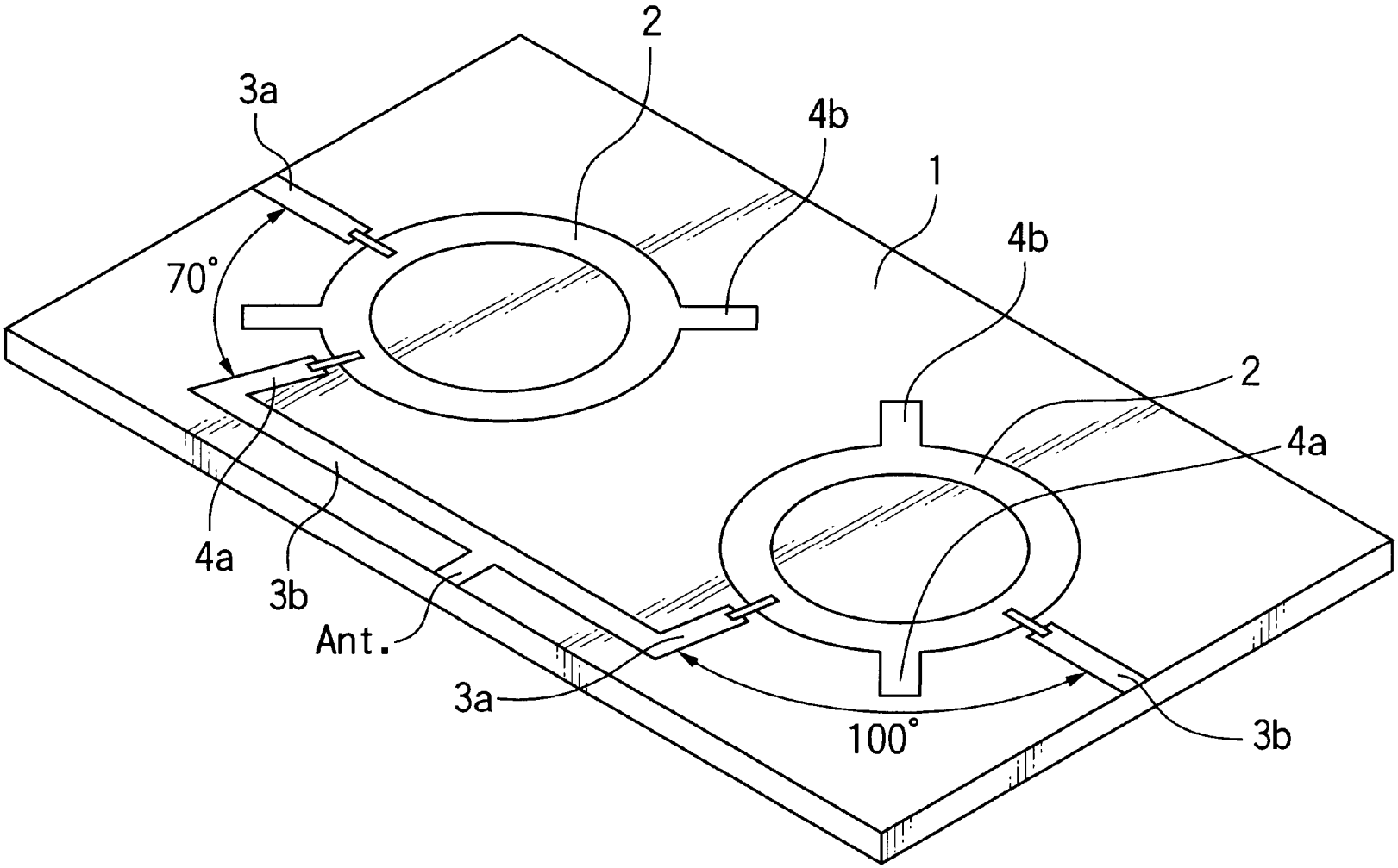
FIG. 9 is a perspective view showing an example of a duplexer constructed according to the present invention.

The principal of the present invention can be advantageously used for design of the duplexer comprised by connecting two filters which have different center frequencies each other. FIG. 9 is a perspective view showing an example of a duplexer constructed according to the present invention, in which two dual-mode filters having the same configuration shown in FIG. 1 respectively are formed in parallel. In FIG. 9, like parts bear like reference numerals of FIG. 1 and their detail description will be left out for avoiding duplicate description.

Figure 10:
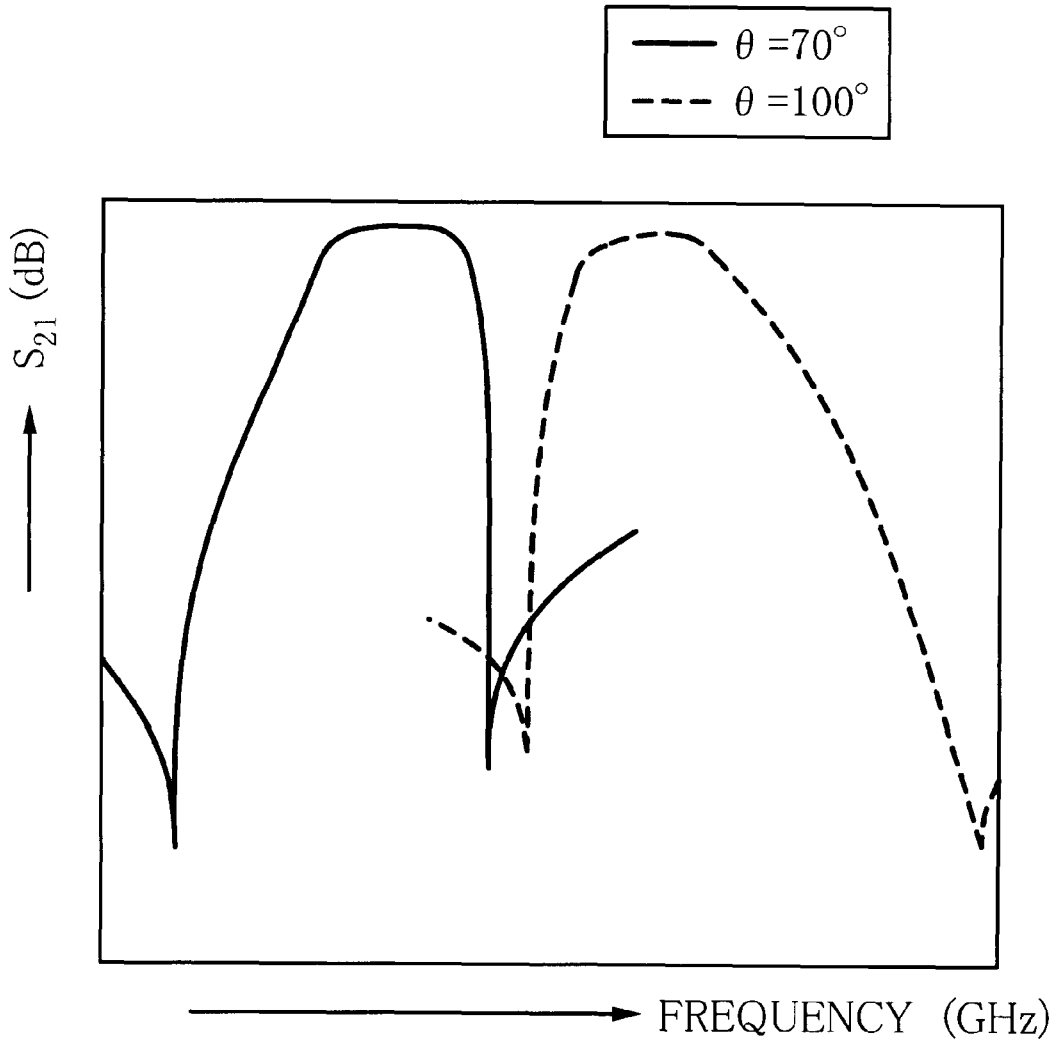
FIG. 10 is a diagram showing transmission characteristics shown in FIG. 9.

In FIG. 9, a filter shown in left hand has the angle between the input/output port 3*a* and 3*b* of 70° and a filter shown in right hand has the angle between the input/output port 3*a* and 3*b* of 100°. The two filters are connected by a line path of 50 Ω which is composed of the input port 3*a* of the one filter and the output port 3*b* of the other filter. FIG. 10 is a diagram showing transmission characteristics of this duplexer. The solid line shows the transmission characteristics of the filter set at the angle between the input/output port 3*a* and 3*b* of 70°, which is designed under the conditions shown in FIG. 7. The dotted line shows the transmission characteristics of the filter set at the angle between the input/output port 3*a* and 3*b* of 100°, in which the pass center frequency and band is set at higher frequency range relative to the filter set at the angle of 70°. In addition, the pass characteristics shown by the dotted line showed a sharp skirt characteristics at the lower frequency band. As seen in FIG. 10, the method of the present invention can provide for a duplexer composed of two filters having excellent separation characteristic.

As previously described, according to the present invention, the size of the stub perturbations 3*a* and 3*b* can be decreased with no change of the filter passbandwidth by selecting the combination of the angle θ between the input/output ports 3*a* and 3*b* and the size, i.e. capacitance, of the stub poles 4*a* and 4*b*.

What is claimed is:

1. A dual-mode filter comprising:

a dielectric substrate;

a circular resonator having a circular periphery, which is formed on said substrate;

a pair of input/output ports connected to the said circular resonator through a capacitance for external circuit coupling, which is formed on said substrate at a symmetrical position with respect to a symmetry plane passing through a center of the circular shape of said circular resonator; and stub perturbations formed on said substrate radially extending along said symmetry plane from opposite positions of said circular resonator in the diametrical direction with each other, wherein said pair of input/output ports are disposed to define an angle different from a right angle therebetween with maintaining a particular passbandwidth according to the size of said stub perturbations.

2. A method for designing a dual-mode filter:

said dual-mode filter comprising;

a dielectric substrate;

a circular resonator having a circular periphery, which is formed on said substrate;

a pair of input/output ports connected to said circular resonator through a capacitance for external circuit coupling, which is formed on said substrate at a symmetrical position with respect to a symmetry plane passing through a center of the circular shape of said circular resonator; and stub perturbations formed on said, substrate radially extending along said symmetry plane from opposite positions of said circular resonator in the diametrical direction with each other;

said method comprising the steps of:

setting a particular passbandwidth of the filter;

finding said capacitance for external coupling;

determining an angle between said pair of input/output ports a value different from a right angle, and figuring out a size of said stub perturbations to achieve said particular passbandwidth.

3. A method for designing a dual-mode filter:

said dual-mode filter comprising a dielectric substrate;

a circular resonator having a circular periphery, which is formed on said substrate;

a pair of input/output ports connected to said circular resonator through a capacitance for external circuit coupling, which is formed on said substrate at a symmetrical position with respect to a symmetry plane passing through the center of the circular shape of said circular resonator; and stub perturbations formed on said substrate radially extending along said symmetry plane from opposite positions of said circular resonator in the diametrical direction with each other; said method comprising the steps of;

setting a particular passbandwidth of the filter;

finding said capacitance for external circuit coupling;

defining a particular value of the attenuation pole frequency, with which the pass value of the filter shows a minimum value, and figuring out a combination of an angle different from a right angle between said pair of input/output ports and a size of said stub perturbations to achieve said particular value of said attenuation pole frequency with maintaining said particular passbandwidth.

4. A duplexer comprising:

a dielectric substrate;

a first dual mode filter including:

a first circular resonator having a circular periphery, which is formed on said substrate, a pair of input/output ports coupled to said first circular resonator through a capacitance for external circuit coupling, which is formed on said substrate at a symmetrical position with respect to a symmetry plane passing through a center of the circular shape of said first circular resonator, first stub perturbations for internal coupling, formed on said substrate radially extending along said symmetry plane from opposite positions of said first circular resonator in the diametrical direction with each other, and a second dual mode filter including:

a second circular resonator having a circular periphery, which is formed on said substrate laterally alongside of said first circular resonator, a pair of input/output ports coupled to said second circular resonator through a capacitance for external circuit coupling, which is formed on said substrate at a symmetrical position with respect to a symmetry plane passing through a center of the circular shape of said second circular resonator, and second stub perturbations for internal coupling, formed on said substrate radially extending along said symmetry plane from opposite positions of said second circular resonator in the diametrical direction with each other, wherein an angle between said pair of input/output ports of said first dual-mode filter and an angle between said pair of input/output ports of said second dual-mode filter are different values with each other with maintaining a particular passbandwidth according to both sizes of said first stub perturbations and said second stub perturbations.

5. A method for designing a duplexer:

said duplexer comprising:

a dielectric substrate;

a first dual mode filter including:

a first circular resonator having a circular periphery, which is formed on said substrate, a pair of input/output ports connected to said first circular resonator through a capacitance for external circuit coupling, which is formed on said substrate at a symmetrical position with respect to a symmetry plane passing through a center of the circular shape of said first circular resonator, first stub perturbations for internal coupling, formed on said substrate radially extending along said symmetry plane from opposite positions of said first circular resonator in the diametrical direction with each other, and a second dual mode filter including;

a second circular resonator having a circular periphery, which is formed on said substrate laterally alongside of said first circular resonator, a pair of input/output ports connected to said second circular resonator through a capacitance for external circuit coupling, which is formed on said substrate at a symmetrical position with respect to a symmetry plane passing through a center of the circular shape of said second circular resonator, and second stub perturbations for internal coupling, formed on said substrate radially extending along said symmetry plane from opposite positions of said second circular resonator in the diametrical direction with each other;

said method comprising the steps of:

setting a particular passbandwidth, and finding said capacitance required for external circuit coupling, with respect to said first and second dual-mode filter respectively;

defining each particular value of a first and a second attenuation pole frequency, with which filter transmitting characteristic of said first and second dual-mode filter show a minimum value; and figuring out a combination of an angle different from a right angle between said pair of input/output ports and a size of said stub perturbations to achieve said particular value of said attenuation pole frequency with maintaining said particular passbandwidth, with respect to said first and second dual-mode filter respectively.

6. The duplexer in accordance with claim 4 wherein the angle of said input/output ports of one of said first and second dual-mode filter has a value smaller than 90°.

7. The duplexer in accordance with claim 4 wherein the angle of said input/output ports of one of said first and second dual-mode filter has a value smaller than 90° and the angle of said input/output ports of the other said first and second dual-mode filter has a value larger than 90°.

8. The method in accordance with claim 5 wherein the angle of said input/output ports of one of said first and second dual-mode filter has a value smaller than 90°.

9. The method in accordance with claim 5 wherein the angle of said input/output ports of one of said first and second dual-mode filter has a value smaller than 90° and the angle of said input/output ports of the other said first and second dual-mode filter has a value larger than 90°.

* * * * *